US006278094B1

(12) United States Patent
Rindfleisch et al.

(10) Patent No.: US 6,278,094 B1
(45) Date of Patent: Aug. 21, 2001

(54) INDUCTION HEATING FOR THERMAL ROLLERS

(75) Inventors: Hans-Jochen Rindfleisch, Berlin; Ludwig Hellenthal, Kirchhundem; Walter Patt, Buchen; Jaxa von Schweinichen, Netphen-Deuz, all of (DE)

(73) Assignee: Walzen Irle GmbH, Netphen-Deuz (DE)

( * ) Notice: Subject to any disclaimer, the term of this patent is extended or adjusted under 35 U.S.C. 154(b) by 0 days.

(21) Appl. No.: 09/438,650

(22) Filed: Nov. 12, 1999

(30) Foreign Application Priority Data

Nov. 16, 1998 (DE) ..... 198 54 034

(51) Int. Cl.[7] ..... H05B 6/10; H05B 6/36

(52) U.S. Cl. ..... 219/619; 219/670; 219/676; 399/330; 492/46

(58) Field of Search ..... 219/619, 618, 219/631, 630, 670, 672, 676, 469, 470, 471; 399/330; 492/46

(56) References Cited

U.S. PATENT DOCUMENTS

| | | | |
|---|---|---|---|
| 3,790,736 | 2/1974 | Matsumura et al. | 219/619 |
| 5,666,627 | 9/1997 | Yamaguchi | 399/330 |

FOREIGN PATENT DOCUMENTS

| | | |
|---|---|---|
| 30 33 482 | 4/1982 | (DE) . |
| 33 40 683 | 6/1984 | (DE) . |
| 34 16 353 | 11/1985 | (DE) . |
| 40 11 825 | 10/1991 | (DE) . |
| 44 10 675 | 9/1995 | (DE) . |
| 195 32 044 | 3/1996 | (DE) . |
| 195 38 261 | 4/1997 | (DE) . |
| 108 877 | 7/1998 | (DE) . |
| 0 511 549 | 7/1995 | (EP) . |
| 0 679 961 | 11/1995 | (EP) . |

*Primary Examiner*—Philip H. Leung
(74) *Attorney, Agent, or Firm*—Collard & Roe, P.C.

(57) ABSTRACT

An induction heating system for a thermal roller comprises a rotatable hollow roller jacket having flanges at opposite ends thereof, the flanges concentrically surrounding the axis of the roller jacket and the roller jacket defining an enclosed space, and an inductor arranged within the enclosed space and inductively coupled with the roller jacket, the inductor consisting of an inductor spool through which a current flows and a magnetic core formed by the roller jacket, the inductor spool comprising a plurality of elongated outer current conductors peripherally arrayed close to an inner surface of the roller jacket and extending parallel to the axis at least across the greatest surface width of the roller jacket, the inductive coupling with the roller jacket being adjustable in zones, and flanges concentrically surrounding the axis, the roller jacket flanges forming bearings for the inductor spool flanges.

29 Claims, 9 Drawing Sheets

INDUCTION HEATING FOR THERMAL ROLLERS

BACKGROUND OF THE INVENTION

1. Field of the Invention

The present invention relates to induction heating for a thermal roller having a roller jacket made of a ferromagnetic material and an inductor spool inside the roller jacket for low-loss transmission and adjustment suitable for processing of the heat output through generation of eddy currents of uniform density in totality or in targeted zones of the outer surface of the roller jacket.

2. Description of the Prior Art

Thermal rollers of the this type consist of a steel cylinder swivel-mounted on front-facing axial flanges. With inductive heating of these rollers the heat is generated directly in the jacket of the hollow cylinder by means of a magnetic alternating field, for which purpose the jacket comprises a material which is sufficiently conductive both electrically and magnetically.

A plurality of inductive heating arrangements for thermos rollers of this kind is known, which utilize induction spools or induction loops of various designs for generating the magnetic alternating field in the roller jacket. They are distinguished essentially by the position and direction of the ampere-turn axis of the induction spools or induction loops relative to the roller jacket or by the direction of the magnetic flow and of the induced eddy current in the roller jacket.

Thus, according to DE 19 53 20 44, an induction roller is known which primarily comprises an induction spool on an iron core in the interior of the roller jacket, of which the ampere-turn axis coincides with the roller axis. The magnetic circuit, in which the magnetic flow develops, essentially comprises the iron core of the induction spool and the ferromagnetic roller jacket, as well as the non-ferromagnetic interstice between the said iron core and roller jacket, forming the so-called air gap of the magnetic circuit.

The magnetic flow generated by the induction spool leaves its iron core, fanning out in the air gap and from there radially entering the roller jacket, where it is bundled in the axial direction before fanning out again in the air gap on exceeding the axial center of the induction spool, and thence entering the iron core again from the other side.

The eddy currents caused by the alternating field in the roller jacket current in a peripheral direction on paths concentric to the roller axis. The eddy current density and the associated heat source density are therefore constant in a peripheral direction. Both dimensions are modified in an axial direction, however, according to the change in the alternating current in the roller jacket as a result of its bundling out of or fanning out into the air gap. For this reason, eddy current density and heat source density in the roller jacket decrease towards its ends from the point located radially over the axial center of the induction spool.

For the purpose of achieving the desired uniform distribution of temperature in an axial direction on the roller surface despite this, in accordance with the known arrangement sealed heat pipes are provided in axial bores of the roller jacket. The heat pipes contain a heat transfer medium simmering in the vicinity of the operating temperature, which brings about a heat and temperature equalization between the center and the ends of the roller jacket on the way to evaporation, convection and condensation.

The manufacture of such axial boreholes in the roller jacket is a very expensive manufacturing process. Moreover, temperature equalization cannot be achieved right into the region of the axis flange in this way.

For this very reason, supplementary auxiliary induction spools are provided in the case of the known induction heat roller in the region of the axis flange. The current generated by the auxiliary induction spools enters the axis flange, where it leads to the additional heating required for complete temperature equalization.

Feeding a correspondingly higher calorific output into the windings of the auxiliary induction spools should prevent any radiation of heat into the unheated regions of the axis flange and into the roller frame during the heating process, thus reducing the time period required for heating up the roller to the level of operating temperature.

An essential drawback to this known arrangement is that it does not permit the development of axial zones of controllable heat output on the thermal roller, in particular in the edge regions of the roller body. This effectively restricts the roller in its usefulness to a predetermined width of the goods webs to be processed and thus to a very narrow range of products. The result is that this may lead to a low level of use of the machine's capacity, which in turn means a low return on capital investment.

One known method for achieving uniform current, eddy current and heat source density in the axial direction and developing axial zones of controllable heat output consists of arranging several induction spools axially adjacent to one another.

According to DE 19538261, each of the induction spools arranged axially adjacent to one another is embedded in an iron core having a U-shaped longitudinal section and terminals of its own.

The U-shaped iron cores and the ends of their flange-shaped legs together form a defined air gap against the inner surface of the roller jacket.

Because of their arrangement with appropriate dimensioning, these magnetic circuits formed by the iron cores and the roller jacket do not permit the current to bundle out from or fan out into the air gap, such that, with the exception of the borderline zones between the individual magnetic circuits, an almost constant current, eddy current and heat source density can be achieved along the roller surface in the axial direction.

This type of generation of the magnetic flow consumes a great deal of energy. When n induction spools are arranged along the roller jacket, the consequence of the smaller air gap width is that the magnetic resistance of a magnetic circuit amounts to approximately the $n^{th}$ multiple and thus the required exciter output is at least the $n^2$ multiple, while the overall exciter output is accordingly more than the $n^3$ multiple of a comparable roller having only one field spool.

The exciter output is converted fully into heat in the induction spool.

To avoid excessive heating of the induction spools, a cooling pipe is provided for a comparable, inductively heated roller, which draws off the heat generated in the induction spools, as in EP 0511549, for instance. This heat is lost to the roller heating, the result of which is a considerable reduction in thermal efficiency.

Another disadvantage of this arrangement is the necessity to monitor and control each of the individual induction spools separately with respect to their heat output, which leads to a very expensive power supply consisting of several independent circuits.

Apart from the fact that additional power losses are caused thereby, such a power supply plant is more expensive and naturally more susceptible to breakdown and accordingly requires continual monitoring during operation.

Particularly low power losses and high thermal efficiency of the inductive heating can be achieved with a solution as disclosed in DE 3416353. This solution contains a ferromagnetic core that fully encases the roller jacket on a peripheral point both inside and outside, which is provided with an exciting coil on its outer limb.

Since the magnetic circuit thus formed has no air gap, the exciter output required for the generation of the magnetic flow is very low. The uniformity of the eddy current and heat source density in an axial direction is very good because of a barely present fanning out of the current in the space between the parallel ferromagnetic limbs of the core.

This solution does not permit the development of axial heat zones. Moreover, a customary coaxial drive is not possible, because the iron core partially covers the roller jacket at its front ends.

In addition, inductive thermal arrangements for rollers are known that have a stationary inductor within the roller. Thus for example DE OS 3033482 describes an inductive heating with an inductor of this kind, consisting of several poles axially neighboring in section and arrayed peripherally in a star formation on an axial through support. Each pole in each section is equipped with one induction winding, so that all the poles of the inductor are electromagnetically active or activatable. The ampere-turn axes of the induction spools are set radially, so that the air gap of the magnetic circuit is located between the ends of the pole and the inner surface of the roller jacket.

The roller jacket constitutes the return yoke of the magnetic circuit between the pole cores of originally neighboring induction spools in a radially opposite direction of ampere-turns. This generates a magnetic field in the peripheral direction in the roller jacket, which surrounds the roller axis between poles with an opposite direction of ampere-turns in segments of a circle with an alternating current direction.

The eddy current induced by the magnetic field flows substantially into a thin layer on the inner and outer surfaces of the roller jacket in alternatively opposed axially directions, so that a longitudinally extended current path in the shape of a torus or of several segments of a torus with a cross section approximating to 90° is formed, whose common axis coincides with the axis of the roller.

In this solution, the thermal sources are situated substantially on the inner and outer surfaces of the roller jacket. Their distributions in the axial direction, especially the progressive heating, is easily controlled by suitably exciting the induction spools of axially neighboring sections. Similarly, it is also possible to control the thermal source distribution and the relative progressive heating in the peripheral direction by suitable staggered excitement of the neighboring peripheral induction spools of the pole star and/or by suitably staggering the air gap between the ends of the pole cores and the inner surfaces of the roller jacket along the roller circumference.

One disadvantage of this and comparable known arrangements is the high cost of material and processing for producing the inductor, especially the induction spools, and the high energy consumption necessary for generating the magnetic field, a consequence of the large volume of their winding, which energy is lost to the heating of the roller surface.

Also thermal sources located on the inner surface of the roller jacket are only partially available for heating the external roller surfaces and transferring the heat to the goods web and then only after a delay.

Finally, the heat radiation to the axis flanges and the load-bearing shaft ends cannot be suppressed effectively enough, as the space available in the axis flange is generally insufficient to house an inductor pole star with the thermal output necessary for thermal compensation.

An arrangement is known from DE OS 4410675 as one possible solution to this problem, wherein the roller is equipped with a resistance heating that can be switched on and off, situated in a hollow volume in the axis flange.

For the purpose of generating a magnetic field shaped at least like the arc of a circle in the peripheral direction in the roller jacket, arrangements are also known in which the inductor spools are situated on the outer circumference of the roller.

A solution of this kind was disclosed in DE 3340683 for example. This arrangement consists of U-shaped pole shoe devices, the ends of whose magnetic limbs are set opposite the external roller jacket surface at a certain distance, which constitutes the non-ferromagnetic air gap in which the roller jacket forms the return yoke. Each pole shoe device has an induction spool. Several pole shoe devices are arrayed axially directly one next to the other and constitute a row of pole shoes that covers the roller externally along the entire roller length requiring heating.

It is possible to array several such rows of pole shoes one next to the other in the peripheral direction, so that the magnetic limbs of neighboring rows are displaced axially to each other.

Nevertheless, this does not eliminate the disadvantages of similar arrangements with an inductor arrayed inside the roller. It is only easier to compensate for the heat radiation at the end of roller with an inductor situated externally, as the flange area can be covered inductively to greater effect in this way.

A further arrangement of this kind is intended to reduce the processing and control expenditure and the related material and energy costs for installing and maintaining a defined axial distribution of eddy current and heat source density, as in the case of the one known from DE OS 4011825. In the solution described here, the inductor is a conductive loop arrayed radially over the surface of the roller, whose current-bearing length can be adjusted by means of conductive, axially displaceable contact bridges between its limbs.

The drawback with this arrangement is that there is no external magnetic conductor of the kind necessary for a sufficiently close inductive coupling of the conductive loop to the magnet jacket. The result is that only a narrow thermal area is created in the immediate vicinity of the conductive loop, of such a kind that its limbs only throw a "thermal shadow" onto the roller surface.

The same shortcoming is found in a comparable inductive thermal arrangement for rollers, disclosed in EP 067 99 61, which also consists of looped conductors over the external surface of the roller. A series of conductive loops forms a conductive loop spiral and is embedded in an envelope in a stationary position over the roller, consisting of a magnetically non-conductive, electrically insulating material. Apart from the fact that, in the absence of the magnetic return conductor, the inductive coupling between the conductive loops and the roller jacket is only weak, the ampere-turns decrease significantly from the center of the conductive spool spiral to its edges, so that it is possible to achieve a constant distribution of flow density and eddy current or of thermal source density neither in the peripheral nor in the axial direction.

SUMMARY OF THE INVENTION

The aim of the invention is to eliminate the recognized shortcomings of the known inductive thermal arrangements for thermal rollers.

The invention is based on the task of creating an induction heating for a thermal roller, with which a predetermined temperature distribution can be produced, adjusted under working conditions and maintained or added to the suit the process over the axial length on the roller surface and in the axis flanges with a negligible control or adjustment expenditure and negligible energy losses in a short time by means of individual controllable thermal areas on the roller surface, without any individual, mutually separate induction spools arrayed axially one next to the other being necessary for the purpose.

According to the invention, this task is achieved in that the roller consists of a hollow cylinder turning on bearings and equipped with axis flanges at its extremities, on whose internal jacket surface a stationary inductor is fitted, at a given radial distance that is at least equal to the maximum deflection of the roller cylinder in working conditions, said stationary inductor consisting of one or more rod or bowl-shaped conductors, arrayed axially in parallel, and having its extremities resting in axial drill-holes in the roller axis flange, through which a one- or multiple-phase alternating current flows, whereby the inductor conductors stretch over the roller's entire bale width as one, or in a magnetically seamless series of successive sections, and are secured at their extremities to the inductor axis flanges and kept at a distance from each other, or linked to each other, by mechanical and electrical means.

When the inductor is powered by a single-phase alternating current, current flows through all the conductors in the same direction, whereby the terminals connecting the inductor to the power source are situated at alternately opposing ends of the roller.

In order to adjust the heated bale width of the roller to the width of the goods web to be processed, it is sufficient to pass the current through the relative axial section of the inductor, i.e. the current is fed into the inductor at the extremities of this section. For this purpose, a loop contacts are provided that are secured to a contact board and pressed against a contact path on the inner jacket surface of the inductor and against a conductor rail arrayed in the roller axis or its vicinity.

The contact boards are arrayed symmetrically about the center of the axis of the roller bale and are each secured to a spindle nut, such that each spindle nut has a pitch in the opposite direction of the same height as the spindle nut on the opposite side of the roller. In the roller axis, there is a two-piece spindle that also has pitches of the same height in the opposite direction symmetric to the axial roller center. By turning the spindle, the contact boards on the spindle nuts are moved symmetrically towards or away from the axial roller center, whereby the heated bale width of the roller is decreased or increased.

The conductor rail is divided into two reciprocally insulated parts in the axial center of the roller. The power is fed at one end of the roller into the conductor rail, which is guided into the interior of the inductor through a central drill-hole in the inductor axle flange. Here the power is guided in the conductor rail to the loop contact secured to the foot of the contact board, passes over a contact bridge to the loop contact situated at the head of the contact board, enters into the contact paths of the inductor jacket, flows through the inductor jacket in an axial direction and then leaves it along the same path in the reverse order to the other end of the roller.

By suitably arraying loop contacts on the head of the contact board and separating the inductor jacket into contact paths insulated against each other, thermal areas of diverse widths and lengths can also be delimited on the circumference of the roller. In order to vary the width of a thermal area, the number of loop contacts on the head of the contact board must be changed. All it takes to adjust the position of the thermal area on the circumference is turning the contact board on the spindle.

By means of the construction of the inductor according to the invention and its array in the roller's internal space, a magnetic field is generated in the roller jacket whole direction is substantially peripheral, whereby the roller jacket basically constitutes the core of the magnetic circuit. If the inductor is powered with single-phase current, the magnetic flow never exits the roller jacket at any point—apart from leakage. This results in a very low magnetic resistance for the magnetic circuit and a respectively low idle power for the generation of the magnetic field. The eddy current path is formed in the roller jacket in the shape of a torus stretched longitudinally in the axial direction with a cross-section tending to 90°, while the eddy current flows in a thin layer with a constant effective electrical conductor cross-section on the internal and the external surfaces of the roller jacket in alternately opposite directions on an axial distance corresponding to the current-bearing stretch of the inductor conductor.

In order to avoid the magnetic field of the conducting sections of the conductor rail outside the axial thermal areas penetrating into the roller jacket and the axle flanges, the conductor rail is magnetically screened throughout. The screen consists of a ferromagnetic jacket which has an air gap for limiting the induction and is covered with a layer of material that conducts electricity well for the purpose of suppressing the magnetic scatter field on its circumference.

If the edges of the roller, especially the axle flanges, are temporarily heated when the roller is heated, this can be taken into account according to the invention by the way that the magnetic screen is constructed with two shells that twist within each other. By twisting the shells, the screen can be partially opened so that an inductive coupling to the axle flanges sufficient for the additional heating can be achieved.

If the power is supplied by a multiple phase alternating current, neighboring conductors on the circumference are each connected together electrically at one extremity of the inductor to closed groups. The phase groups thus formed are insulated from each other and provided with separate connections to the power source at the one extremity of the inductor, whereas all the conductors are connected together conductively at the other extremity of the inductor.

Should it be necessary to provide adaptation to the power supply, the inductor conductors can consist of more than one reciprocally insulated partial conductors, whereby said partial conductors of two phase groups displaced through 180° are switched in series in a single or multiple phase loop, so that the result is an inductor spool with the desired number of windings.

Unlike the single-phase arrangement, in the case of the two-phase arrangement, the eddy current path consists of two torus segments through which the current flows in opposite directions. In this way, each phase group forms its own magnetic circuit. At the borderline between two neighboring phase groups, the flow exits the roller jacket and enters the internal volume of the roller, while at the opposite phase borderline or the one disposed next on the circumference, it returns into the roller jacket. To do this, it takes a route along the magnetic flow axes that stretch between the borders situated at the roller circumference between each pair of phase groups and the roller axis. At this point, a transverse yoke, consisting of ferromagnetic material and constituting a negligible magnetic resistance, is arrayed as a component of the inductor. The magnetic resistance in the magnetic flow axis is thus determined substantially by the magnetically effective, non-ferromagnetic air gap between the extremities of the transverse yoke and the inner jacket surface of the roller.

The transverse yoke stretches in the axial direction along the entire length of the inductor and is sub-divided into several axial sections which can be turned independently of each other at least $\phi/2$ out of the magnetic flow axis, where $\phi$ is the electrical angle between the phase currents.

For this purpose, each transverse yoke section is preferably housed with its extremities on the internal jacket surface of the inductor and its rotation shaft in an axial drill-hole of the inductor axis flange, so that the rotation shafts of the transverse yoke sections protrude from the roller axis flange in such a way that they are accessible from outside. Each one of the transverse yoke sections is connected solidly to its rotation shaft. The rotation shafts are hollow shafts positioned one inside the other in such a way that they can rotate against each other, each of them being externally accessible at one extremity and connected at its other extremity with one each of the transverse yoke sections.

In order to adjust the rotation angle of the transverse yokes, the free extremities of the hollow shafts are preferably connected via a switchgear to an operator motor.

The inductor phase groups generally stretch across different fields of circumference of the roller jacket, so that the greater heat source densities on the roller surface should usually be generated via the phase group with the shortest distance on the roller circumference.

In order to achieve a clear delimitation of heat zones on the roller circumference in this way, the magnetically effective air gap between the extremities of the transverse yoke and the internal jacket surface of the roller jacket must be kept as small as possible. This means that the radial height of the inductor conductor must be as small as possible.

According to the invention, it can be taken into account that the inductor conductors are shaped like cylindrical shells. These conductor shells can be equipped on their internal surface with a thin, electrically insulating plastic coating with self-lubricating properties, such as teflon, on which the extremities of the transverse yokes, also coated with such a plastic material, are housed in such a way that they can glide.

A further reduction of the magnetic air gap can be achieved if the inductor is connected solidly to the roller jacket. In this case, the necessary gap between the external jacket surface of the inductor and the internal jacket surface of the roller is no longer determined by the maximum deflection of the roller, but only by the necessary electrical insulation between the roller and the inductor.

As the inductor now turns together with the roller, for the purpose of maintaining a stationary magnetic flow axis, the individual conductors of the inductor are switched in series in loop or wave form along the lines of a direct current commutator winding and guided individually at one extremity of the inductor to the laminas of a collector, through which the electrical connection to the power source is made.

If the transverse yoke is turned out of its bridge position between the phase borders, the magnetic resistance of the magnetic circuit increases significantly. Correspondingly, the magnetic flow and with it the heat output induced in the roller jacket both decrease significantly.

In an inductor with a symmetric, two-phase conductor array, the phase borders are situated diametrically opposite each other on the roller circumference. If the transverse yoke is turned through 90° about its longitudinal axis in the middle of the phase groups, the ampere-turns of the inductor rise with respect to the transverse yoke, so that no flow is driven over the transverse yoke. Apart from the comparable small leakage, there is then no magnetic flow in the roller jacket, so that practically no or only a very small thermal output is generated.

By turning the transverse yoke, it is thus possible to reduce the resulting ampere-turns of the magnetic circuit and thus the magnetic flow and the thermal output generated in the roller jacket seamlessly from its highest value to practically zero, without having to undertake any alterations in the inductor power circuitry for this purpose.

Contact-free adjustment of the roller heating is thus possible; any decay caused by wear and tear on the contact is thus eliminated at the outset and energy losses caused by the control mechanisms are so small as to be negligible.

This contact-free adjustment of the thermal output can be undertaken equally across the entire bale width of the roller or by sections, e.g. at the extremities of the roller, as only those transverse yoke sections that are situated in the relative positions are turned. In this way, it is possible to achieve every desired distribution of heat source or temperature across the bale width of the roller, without having to stop the machinery for this purpose. Thus the temperature distribution can be optimized in working conditions with the aid of continuously collected process and product data.

A progressive heating is achieved on the roller circumference according to the invention by arraying the phase groups in such a way that they stretch over circumference zones of different sizes. In the case of an inductor with a non-symmetric, two-conductor array of this kind, the borders between the phase groups are no longer situated diametrically opposite each other; only the central angles of the phase groups continue to increase to 360°. As the same current flows in each of the two phase groups, their ampere-turns are identical. Meanwhile, the magnetic resistances of their magnetic circuits behave in proportion and their flows in inverse proportion to their central angles. Naturally, this is only the case as long as the magnetic resistance of the magnetic circuit is determined by the roller jacket and the magnetic resistance situated in the common ampere-turn axis of the non-ferromagnetic air gap between the transverse yoke and the roller jacket and of the transverse yoke itself does not appear to dominate it.

But as the permeability of the roller material is highest precisely in the case of the relatively low magnetic field forces in the roller jacket, the air gap must be made extremely small in order to satisfy this condition. However, the necessary thickness of the conductors of the inductor already sets limits to this, even if they are already constructed to be as thin as possible, in the interests of suppressing and minimizing the losses of inductor eddy current output in a radial direction, which is achieved for example by using shell-shaped conductors or conductors consisting of several thin, reciprocally insulated, conducting layers in a radial direction.

In order to satisfy the above-mentioned condition nevertheless, the invention provides for the possibility to superimpose a direct current magnetic flux on the alternating current magnetic flux of the inductor, which helps push the magnetic field force in the roller jacket into an area of sufficiently lower permeability of the B-H curve of the jacket steel, without thereby significantly reducing the permeability of the magnetically conducting material of the transverse yoke. This can be achieved by choosing a suitable ferromagnetic material and a sufficiently large magnetic conductor cross-section of the transverse yoke.

A direct current source is coupled into the alternating current circuit of the inductor in the known way via a low-pass filter, e.g. a throttle.

The transverse yoke is stacked out of thin, insulated sheets and held together with a GFK bandage, for example, so that the individual sheets are arrayed to lie in the direction of flow. This effectively suppresses eddy currents in the transverse yoke.

According to the invention, the magnetic resistances of the phase groups can also be adjusted into the desired relationship by varying the size of the roller jacket cover using the transverse yoke in the area of the phase border and thus the surface of the air gap for the contiguous phase groups. This can be done by suitably shifting the axis of the transverse yoke out of the ampere-turn axis. Instead of or in addition to this, the relationship of the magnetic resistances can also be adjusted by differentiating the size of the air gap for both the phase groups, which can be done by giving the transverse yoke a suitably asymmetric shape at its extremities in the form of suitably shaped pole shoes.

If the phase group with the smaller central angle constitutes the zone with a higher specific thermal output, its magnetic circuit will receive the smaller air gap and the larger air gap surface, in such a way that the magnetic alternating current driven by the ampere-turns of this phase group via the transverse yoke through the roller jacket and the thermal source density generated thereby is relatively higher than on the rest of the roller circumference.

By turning the inductor together with the transverse yoke against the roll gap, this thermal zone can be brought into any desired position to suit the process being used at the time.

In this way, an optimum amount of heat can be transmitted to the rolling stock, while at the same time achieving an optimum energy consumption.

The energy losses that arise through convection and heat radiation on the larger part of the roller circumference, i.e. that part not in contact with the rolling stock, can be reduced significantly with the smaller thermal output and the related reduction in the surface temperature in this area of the circumference.

As a consequence of the stretched axial conductor array along the entire current-bearing length of the inductor, the peripheral magnetic excitement of the roller jacket is necessarily of uniform size. This also holds in general for the magnetic flux and for the flow and thermal source density when the inductor is powered with a single phase. If it is powered with a multiple phase, this holds at least across the width of a transverse yoke section and also across the entire bale width, as long as all the transverse yoke sections have the same angular position in relation to the ampere-turn axis. In this case, the eddy current path only transfers from the outer to the inner diameter of the roller jacket at the end of the inductor.

No special construction measures, such as for example heat pipes in drill-holes in the roller jacket, are therefore necessary in principle for controlling the magnetic border field and for evening out the axial temperature distribution. It is possible to target the control of the thermal border area, in particular at the point of transition to unheated or weakly heated sections of the bale, by reciprocally turning the transverse yoke correspondingly in the area of transition. In this case, the eddy current paths fan out radially on the borders between neighboring transverse yokes with related alterations in the eddy current density in the boundary layers.

The thermal time constant of the roller heating on the external roller surface is very low, as the thermal sources are only in a thin boundary layer on the roller jacket. Both the overall heat transfer resistance and the thermal capacity are thus extremely small in relation to the external roller skin for the thermal flow. This of course only holds for the heat sources situated on the external roller skin. The thermal sources also generated on the internal jacket surface of the roller as a consequence of the skin effect delay the heating process. Moreover, part of the thermal flow exiting here flows off into the inductor space and is thus lost to the roller heating.

According to the invention, this undesirable effect is eliminated by applying a layer of a material with a significantly smaller specific electrical resistance, e.g. copper, immediately contiguous to the internal jacket surface of the roller cylinder, this layer being as thick as the depth to which the electrical field penetrates. In this way, the inductively transmitted thermal output is apportioned on the roller in relation to the specific resistances on the internal and external jacket surfaces of the roller, so the heat is primarily generated on the external roller surface.

It is possible to accelerate the heating process in one further, very significant way by preventing the thermal efflux from the skin areas of the roller jacket in the area of the axis flange and the roller housing.

For this purpose, according to the invention, the entire or almost the entire length of the axis flange can be subjected to an additional inductive heating by means of suitably arraying the exit lines or the connection lines of the inductor in the ring-shaped area between the axis flanges of the rotor and the inductor.

In the case of a two-phase inductor, both the exit lines are arrayed displaced by 180° on the circumference in channels in the inductor axis flange. In the coaxial ring-shaped area between the two axis flanges, two pole bridges displaced by 180° on the circumference are inserted, which produce the magnetically conductive connection between the magnetic poles of the axis flanges of the roller and the inductor. So if the connection lines of the pole bridges form a 90° angle with the connection lines of the power conductor, the additional heating is switched on; if the angle is 0°, it is largely switched off.

In order to achieve as complete a decoupling as possible in this angular position, plates made of a good electrical conductor material are set into the outside of the axis flanges of the inductor; these plates provide electromagnetic screening for the ring-shaped area in the zones of the circumference between the conductors and the poles.

A particularly good switching relationship is achieved if the pole bridges bridge the ring-shaped area with any air gap, i.e. with both extremities touching the opposing jacket surfaces of the axle flanges of the roller and the inductor. For this purpose, they are integrated appropriately as segments in a bearing bush.

BRIEF DESCRIPTION OF THE DRAWING

The invention is illustrated in greater detail hereunder with the following examples of embodiments. The relative schematic drawings show.

DETAILED DESCRIPTION OF PREFERRED EMBODIMENTS

Figure 1:
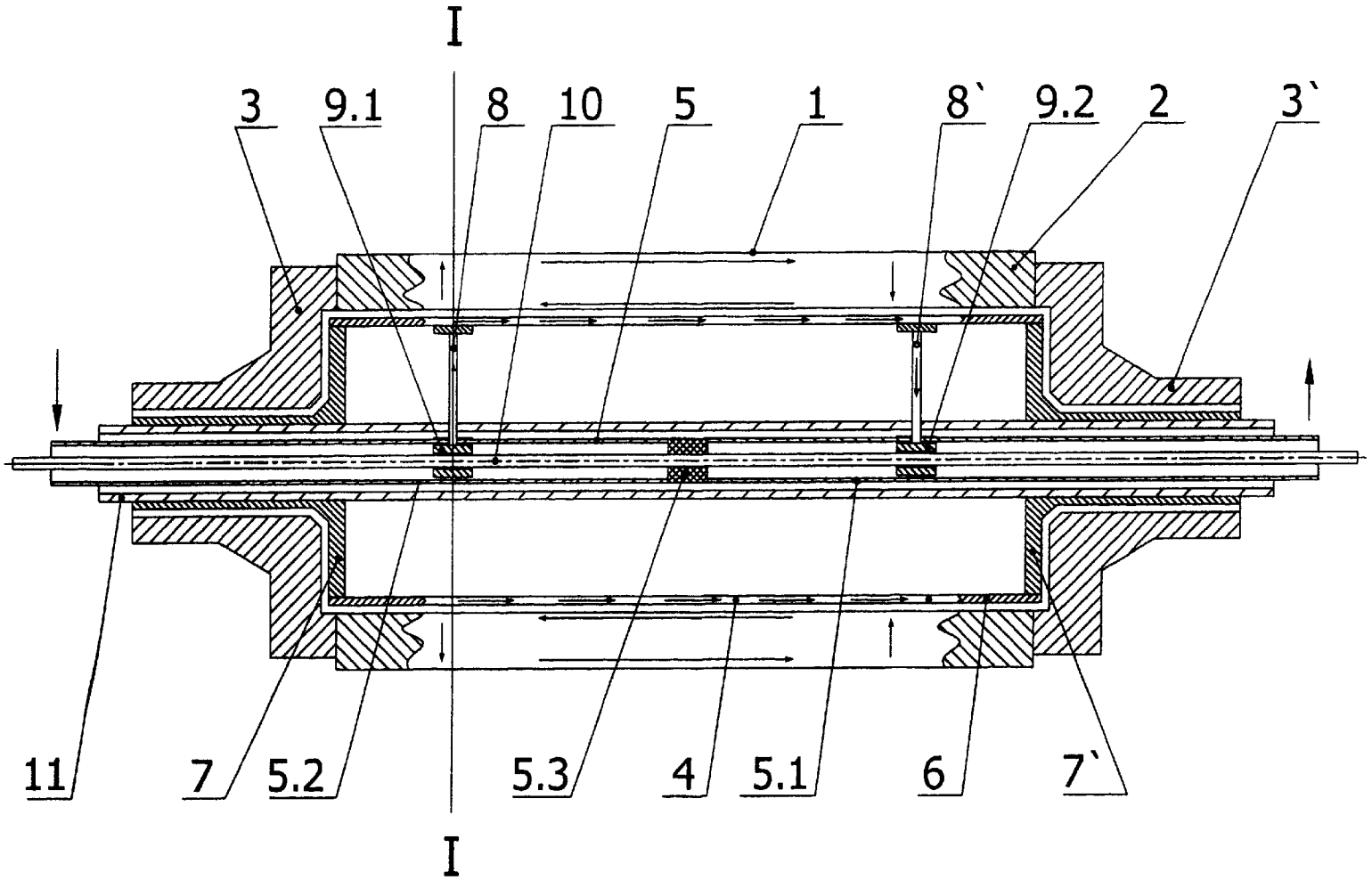
FIG. 1 a longitudinal cross-section through a thermal roller with an inductor in a single-phase embodiment FIG. 2 a cross-section I—I through FIG. 1

The induction heating for a thermal roller 1 consists of a roller jacket 2, axis flanges 3, 3', on which the thermal roller 1 rests in such a way that it can rotate, and the inductor 4, which is inserted with axis flanges 7, 7' in axial drill-holes in the axis flanges 3, 3' of the thermal roller 1.

Figure 2:
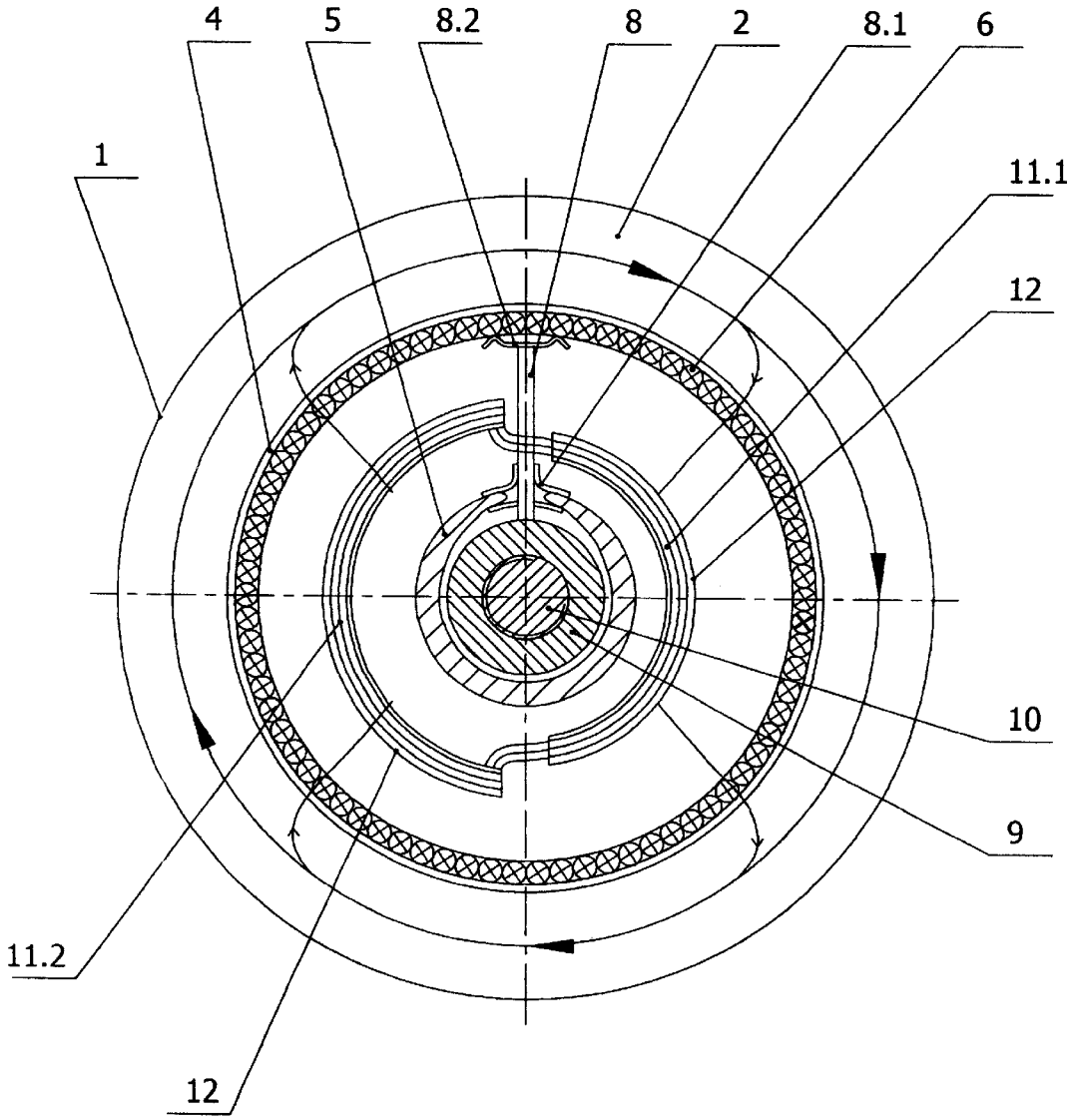

As FIG. 1 and 2 show, the inductor 4 is arrayed inside the roller jacket 2 and consists in the single-phase embodiment illustrated here of an internal current conductor 5, which is sub-divided by an insulation element 5.3 into two electrically separated partial conductor elements 5.1 and 5.2 connected together mechanically, external current conductors 6, loop contact boards 8, 8' with internal loop contacts 8.1, 8.1' and external loop contacts 8.2, 8.2', the spindle nuts 9.1, 9.2 and a spindle 10, as well as a magnetic screen 11 of the internal current conductor 5.

The external current conductors 6 of the inductor spool 4' can be round or profile rods, but also cylinder shells and are arrayed in a uniform distribution on the internal circumference of the roller jacket 2 and secured at their extremities in axis flanges 7, 7' of the inductor 4. The current conductor 6 is connected to a power source from both extremities of the thermal roller 1 via the internal current conductor 5, the internal loop contacts 8.1, 8.1', the loop contact boards 8, 8' and the external loop contacts 8.2, 8.2'. The external current conductors 6 are electrically connected together in the peripheral direction along their entire length or in sections, so that the current of the external loop contacts 8.2, 8.2' is distributed uniformly and peripherally on the external current conductors 6. Between the two loop contact boards 8, 8', the current flows in the external current conductors 6, in the same direction on the entire inductor circumference, as illustrated by arrows in FIG. 1 and FIG. 2. In this way, a magnetic flux is generated in the roller jacket 2, which flows in the peripheral direction, as illustrated by the arrows in FIG. 2.

The flux induces eddy currents in the roller jacket, which flow in the current paths represented by arrows in FIG. 1. The length of the eddy current paths and thus the heated width of the roller jacket can be adjusted by suitably varying the current-carrying length of the external current conductor 6. This is achieved by activating the spindle 10, which is housed in the tubular internal current conductor 5 in such a way that it can be turned at its extremities and is electrically insulated against the internal current conductor 5. The insulation may take the form, for example, of a gliding bearing bush made of teflon.

The spindle 10 consists of two partial elements of equal length with a thread pitch of equal but opposing size. The spindle nuts 9.1 and 9.2 situated on the spindle 10 also have correspondingly reciprocally opposing thread pitches of the same size and are arrayed on the spindle 10 symmetrically to the axial roller center.

When the spindle 10 is turned, the spindle nuts 9.1, 9.2 move together with the loop contact boards 8, 8' along stretches of the same length, either towards each other or away from each other, according to the direction in which it is turned. In this way, the current-carrying stretch of the external current conductor 6 and thus the inductively heated width of the roller jacket 2 decreases or increases correspondingly.

In order to prevent an induction of eddy currents in the roller jacket 2 outside the stretch delimited by the loop contact board 8 brought about by the current flowing in the internal current conductor 5, the internal current conductor 5 is provided with a magnetic screen 11 consisting of the shells 11.1 and 11.2. Each of these two shells is made up of thin, reciprocally insulated ferromagnetic sheets and has an electromagnetic screen 12 made of material that conducts electricity well on its external surface. The magnetic screen 11 stretches along the entire length of the thermal roller 1, but at least along the entire length of the internal current conductor 5 between the connections of its partial elements 5.1 and 5.2 on the source of power not illustrated here. This method prevents an induction of eddy currents not only in the peripheral areas of the roller jacket 2, but also in the axis flanges 3, 3' and 7, 7'.

In certain cases, however, e.g. when the thermal roller 1 is heated up, an active influence of the temperature range in these areas is desirable.

According to the invention, this is taken into account by the construction of the magnetic screen 11 in the way that the two shells 11.1 and 11.2 have varying diameters, so that they can swivel within each other and thus partially release the internal current conductor 5 depending on the angle of rotation. In this way, it is possible to raise the inductive coupling of the internal current conductor 5 on the axis flanges 3, 3' or the peripheral area of the roller jacket 2, and thus also the thermal output transferred there inductively, seamlessly from zero to the value desired from time to time.

In order to adjust the angle of rotation, at least one of the shells 11.1 or 11.2 of the magnetic screen 11 on at least one side of the thermal roller 1 is extracted from the inductor 4 through its axis flange 7 far enough to be accessible from outside.

When the roller 1 is operating, the inductor 4 is stationary, together will all the elements built into it. That is way the axis flange 7 of the inductor 4 is swivel-inserted in the axis flange 3 of the thermal roller 1 and secured to the roller housing at its extremities. The internal, tubular current conductor 5 is also attached to the machine housing with the extremities of its partial elements 5.1 and 5.2 and connected solidly to the electrical plant of the power source. It supports the spindle 10 on its internal extremity and the shells 11.1 and 11.2 of the magnetic screen 11 on its external extremity, in each case on electrically insulating bearings. The bearings of the shells 11.1 and 11.2 have different external diameters and are arrayed with an axial displacement, so that they enable the shells 11.1 and 11.2 to swivel within each other. The current conductor 5 is extracted from the internal space of the thermal roller 1 with the spindle 10 and the magnetic screen 11 through an axial drill-hole in the axis flange 7 of the inductor 4 externally accessible from both sides.

Figure 3:
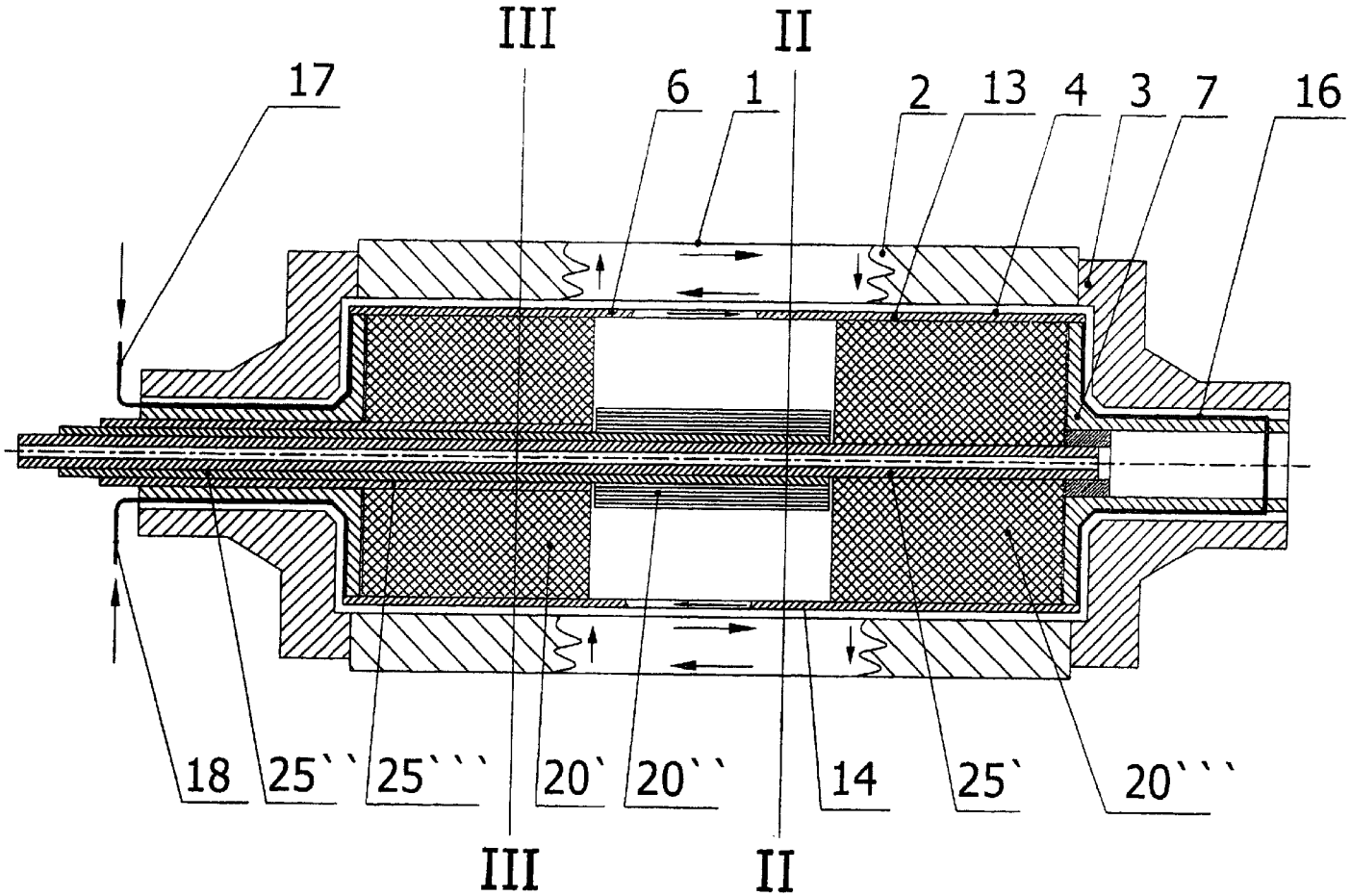
FIG. 3 a longitudinal cross-section through a thermal roller with an inductor in a two-phase embodiment FIG. 4 a cross-section II—II through FIG. 3
Figure 4:
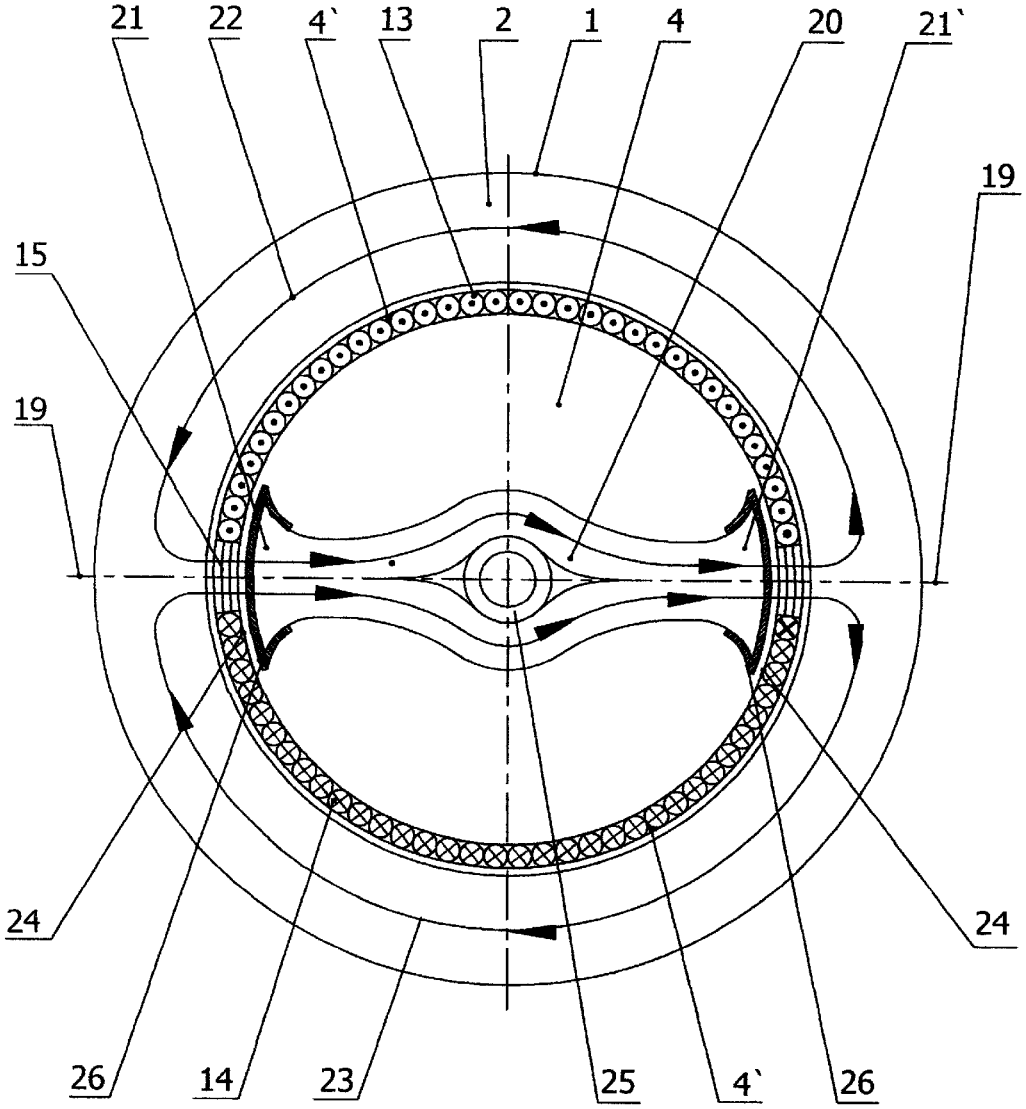

FIG. 3 and FIG. 4 illustrate an inductive heating arrangement with an inductor 4 in a symmetric two-phase embodiment.

The external current conductors 13' and 14' of the inductor spool 4' are divided into two phase groups 13 and 14 of equal size and separated electrically by insulation rods 15. The electrical phase angle is 180°, i.e. the current flows in one of the phase groups from one extremity of the inductor 4 to the other and back in the other phase group. The current feed lines 17 and 18 are situated at one extremity of the inductor 4, while the two phase groups 13 and 14 are connected to each other via the phase bridge 18 at the other extremity of the inductor.

The current conductors 13', 14' of the two phase groups 13, 14 have a common ampere-turn axis 19, which stretches between the roller axis and the peripheral phase borders. The transverse yoke 20 with the pole shoes 21 is arrayed symmetrically in the ampere-turn axis.

Because of the opposing direction of rotation of their ampere-turns, each of the phase groups 13, 14 forms its own magnetic circuit 22 or 23. The roller jacket 2 forms core of one such magnetic circuit on the section covered respective phase group 13 or 14. The two halves of the core of the roller jacket 2 meet with their respectively homonymous poles at the phase borders. The transverse yoke 20 forms the common bridge of the two magnetic circuits between the opposed, diametrically opposite poles of the two halves of the core. The directions of the flows generated by the phase groups 13 or 14 are represented by arrows in FIG. 4.

The magnetic resistance of the magnetic circuit 22 or 23 is determined by the width and the surface of the air gap 24 between the transverse yoke 20 and the internal surface of the roller jackets 2. The narrower the air gap and the greater its surface, the smaller its magnetic resistance will be and the greater the magnetic flux with a given ampere-turns or exciter output, i.e. the narrower the inductive coupling between the inductor 4 and the roller jacket 2 will be. The air gap is thus intentionally as narrow as the radial thickness of the external current conductors 13', 14' and the deflection of the roller jacket 2 allow.

The surface of the air gap can be expanded by increasing the width of the pole shoes 21, 21' in the peripheral direction as far as the necessary uniformity of the peripheral flow or thermal source density distribution in the roller jacket 2 allows. On the other hand, the peripheral flow density and thermal flow density distribution can be varied within extensive limits by suitably shaping and expanding the pole shoes 21, 21' at the roller circumference.

The inductive coupling between the inductor 4 and the roller jacket 2, i.e. the thermal output that can be transmitted with a predetermined induction flow to the roller jacket 2, can be reduced from its maximum value to practically zero if the transverse yoke 20 is turned through 90° out of the ampere-turn axis 19.

Figure 5:
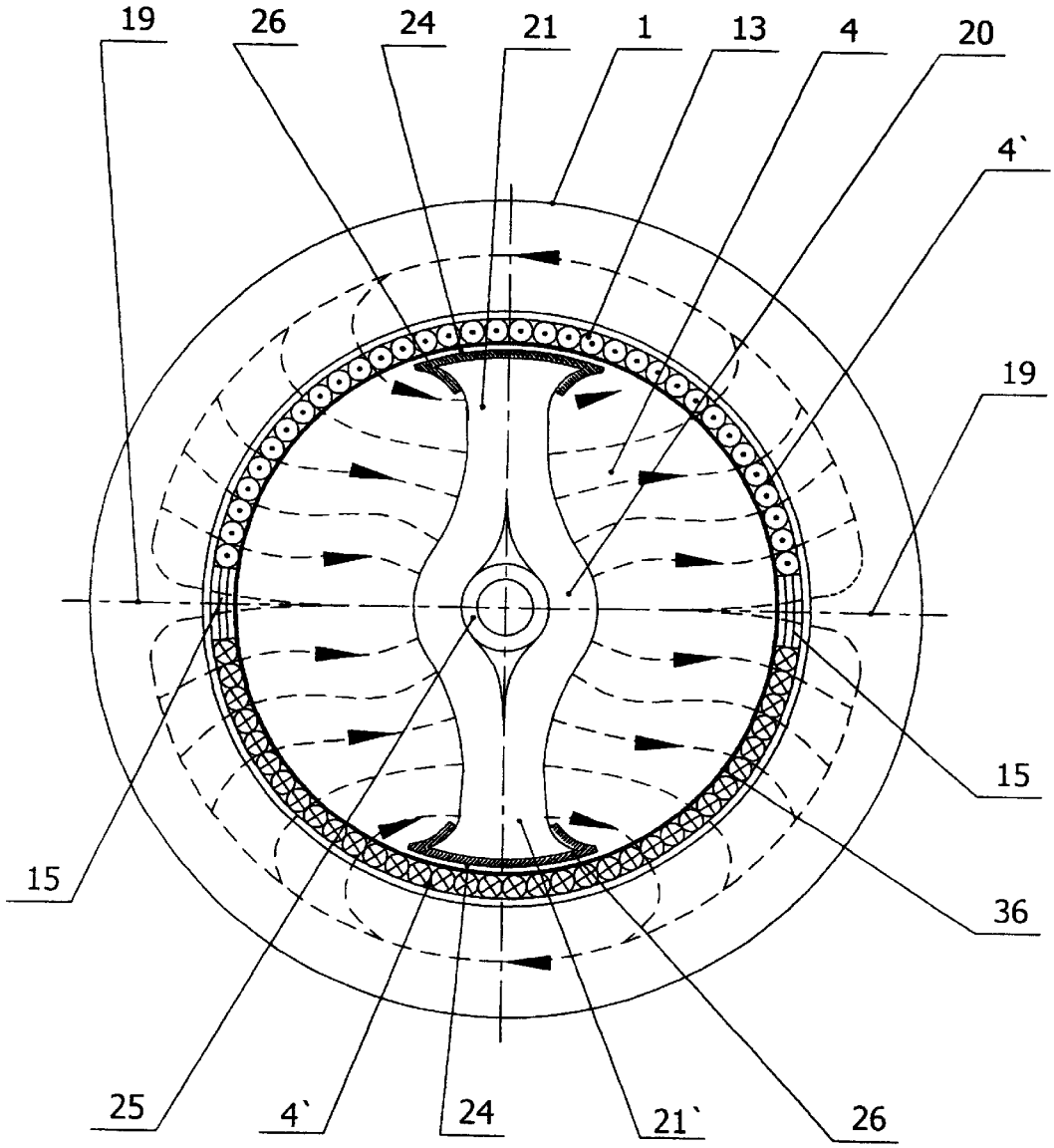
FIG. 5 a cross-section III—III through FIG. 3

The magnetic field in this borderline position is illustrated in FIG. 5. the ampere-turns of the phase groups 13 and 14 cancel each other out with regard to the transverse yoke 20, so that only one leakage can be formed. Because of the significantly longer path through the non-magnetic space inside the roller jacket 2, compared to the air gap 24, the leakage is notably inferior to the flow in the bridge position of the transverse yoke 20. Because of the squared dependency of the thermal source on the flow density, this applies to an even greater extent to the thermal output transmitted inductively. Thus, if the inductor flow is constant, the thermal output can only be varied by turning the transverse yoke 20 within extensive limits.

This produces a significantly simplified control, compared to known arrangements, of the inductor flow for adjusting and maintaining the temperature distribution on the surface on the thermal roller 1. The current only has to be kept at a predetermined constant value. The surface temperature of the thermal roller 1 can then be adjusted simply with an angle of rotation of the transverse yoke 20.

In order to be able to set a predetermined temperature profile across the bale width of the thermal roller 1, in particular heat areas of different widths, the transverse yoke 20 is divided axially into several sections 20', 20", 20'" that can be turned in opposing directions, as illustrated schematically in FIG. 3.

The two external transverse yokes 20' and 20'" are situated in the borderline position of a minimal inductive coupling between the inductor 4 and the roller jacket 2. The central transverse yoke 20" occupies the bridge position and thus produces the maximum inductive coupling.

Because of this layout, eddy currents are only generated in the central axial section of the roller jacket 2. The eddy current paths and the direction of the eddy currents are illustrated by the arrows. As the current in the current conductors 13' and 14' of the phase groups 13, 14' cannot vary into the flow direction indicated by arrows, the magnetic flux density and thus also the thermal source density are necessarily constant in the axial direction, as long as the inductive coupling between the inductor 4 and the roller jacket 2 remains constant. This applies along the axial length of the transverse yoke 20, as illustrated in FIG. 3.

In the peripheral area of the central section 20" of the transverse yoke 20, however, the coupling decreases significantly, so that the current flowing in the axial direction drops to zero, as it fans out in the axial direction. This causes the layers of the eddy current path situated in the vicinity of the surface on the internal and external circumference of the roller jacket 2 to blend into each other via the extremities of the transverse yoke 20. The resulting electromagnetic and thermal peripheral field may extend independently of the thickness of the roller jacket 2 considerably beyond the axial extremities of the transverse yoke 20 and stretch into the area of the axis flange 3 of the roller 1, in particular when the external sections 20', 20'" are also situated in the bridge position.

The transverse yokes 20 with their sections 20', 20", 20'" rest on concentrically arrayed hollow shafts 25, 25', 25" swivel-mounted on each other, whereby on the one side of the thermal roller 1 the innermost hollow shaft 25' and on the other side of the thermal roller 1 the outermost hollow shaft 25" is swivel-mounted on the axis flange 7 of the inductor 4. On one side of the thermal roller 1, the extremities of the hollow shafts are extracted through the axial drill-hole of the axis flange 7 of the inductor 4 to be accessible from outside. There, they can be connected to an adjustment device that is part of a thermostat.

In order to relieve the hollow shafts 25 and minimize the air gap, the transverse yokes 20 are mounted directly on the internal jacket surface of the inductor 4, i.e. on the internal surfaces of the current conductors 13', 14'.

For this purpose, the surface of the pole shoes 21 is coated with an insulating cap 26 made of electrically insulating and temperature-stable material with self-screening properties, such as teflon.

Figure 6:
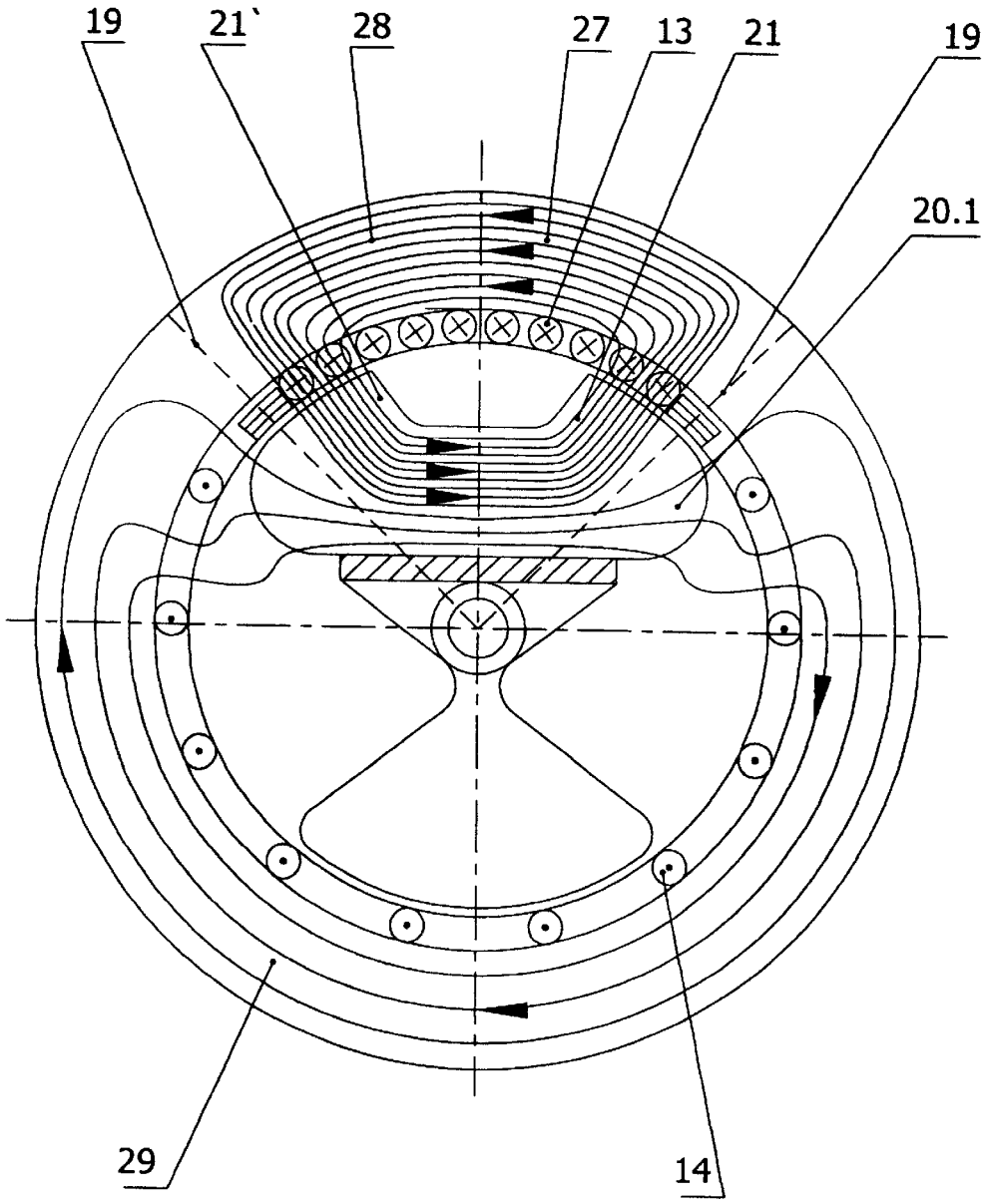
FIG. 6 a cross-section through a thermal roller with an inductor in a two-phase embodiment and an asymmetric array of the phase groups as in FIG. 4 (heated central section)
Figure 7:
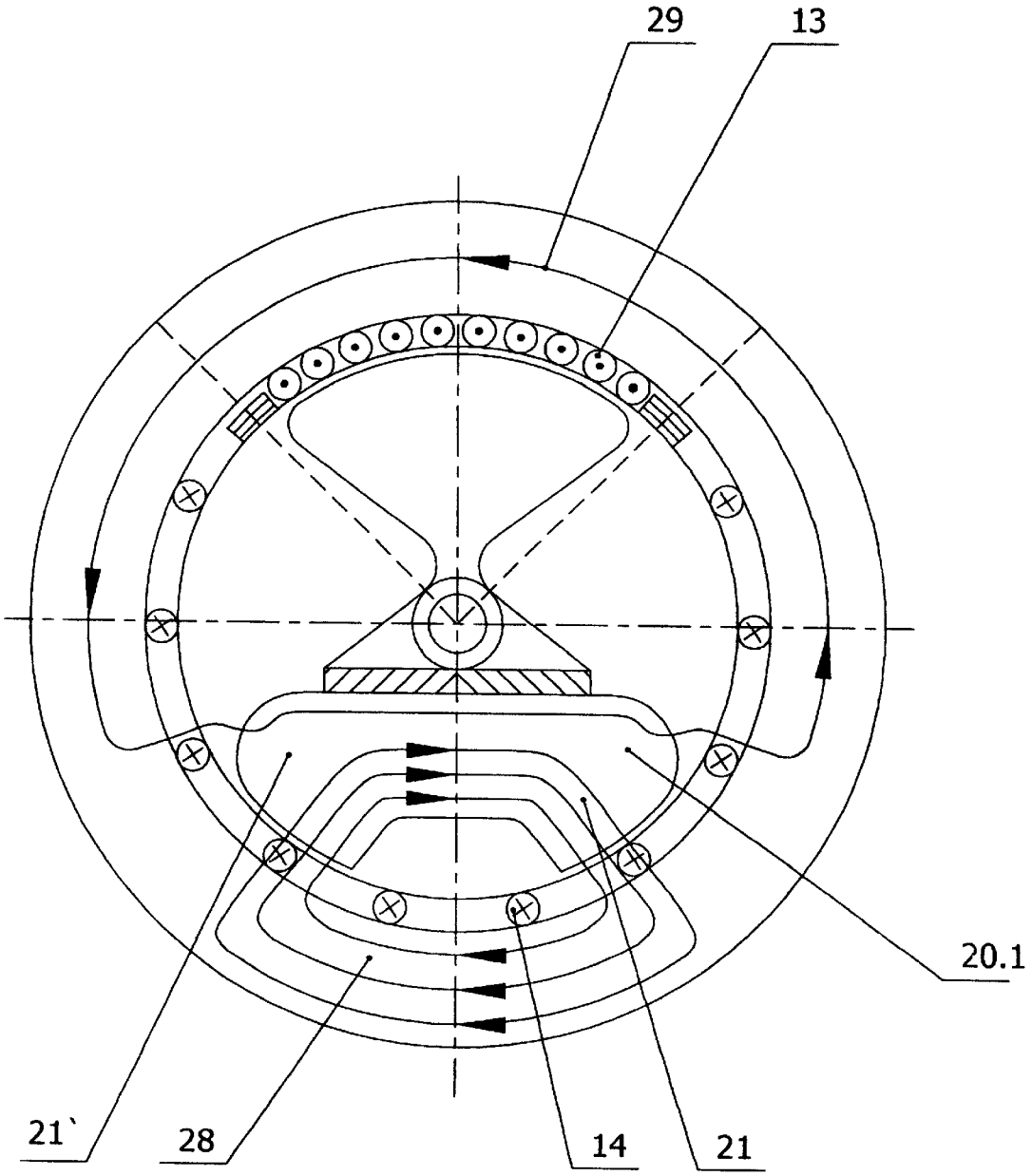
FIG. 7 a cross-section through FIG. 6, but with a yoke displaced through 180° (unheated skin area)

FIG. 6 and FIG. 7 illustrate how the thermal roller 1 can also be arrayed to heat peripheral zones according to the invention.

In order to concentrate the thermal output on the peripheral heating zone 27, the phase groups 13 and 14 stretch over areas of a varying size of the roller circumference, although they conduct the same current. The ampere-turns of both phase groups 13, 14 are thus equal. Their ampere-turn axes 19 form the edges of a segment of a circle that includes the peripheral heating zone 27 with the phase group 13.

The transverse yoke 20.1 is arrayed in the ampere-turn axis 19. By suitably shaping the pole shoes 21, 21' and the air gap 24, the magnetic resistance of the magnetic circuit of the phase group 13 can be made to be significantly lower than the magnetic resistance of the magnetic circuit of the phase group 14, which already has a higher magnetic resistance because of its longer distance.

The example in FIG. 6 is based on the assumption that the magnetic resistance of the magnetic circuit of the phase group 13 with the current conductors 13' comprises one third of the magnetic resistance of the magnetic circuit of the phase group 14 with the current conductors 14'. It follows that flow generated in the magnetic circuit of the phase group 13 by the ampere-turns of the current conductor 13' is three times greater than the flow generated in the magnetic circuit of the phase group 14 by the equally large ampere-turns of the current conductor 14', as is illustrated by the number of arrows in FIG. 6. As the thermal source density is a function of the square of the flux density, it is therefore nine times higher in the heating zone 27 than on the rest of the roller circumference. It follows that 75% of the thermal output is transferred in the heating zone.

FIG. 7 shows the magnetic field that is formed with unaltered ampere-turns if the transverse yoke 20.1 is turned through 180° out of the heating zone. With reference to the transverse yoke 20.1, the phase ampere-turns cancel each other out partially, whereby the ampere-turn axes and the related magnetic circuits are impressed in this case by the transverse yoke 20.1. In the example in question in FIG. 7, the resulting ampere-turns of the two magnetic circuits comprise one quarter of the phase ampere-turns.

If the same assumptions are made about the magnetic resistance of the magnetic circuit, the flux in the internal magnetic circuit 28 enclosed by the limb of the transverse yoke 20.1 in turn comprises three times the flux in the external magnetic circuit 29. With reference to the maximum flux density in the heating zone 27 as per FIG. 6, however, this is only one quarter, because of the low ampere-turns.

This means that the maximum thermal source density in the position of the transverse yoke 20.1 according to FIG. 7 comprises only one sixteenth of the maximum thermal source density in the position of the transverse yoke 20.1 according to FIG. 6.

This results in a total transmitted thermal output of 9% of the full inductive coupling in FIG. 6.

The power connection lines 17 and 18 to the current conductors 13' and 14' of the inductor spool 4' are arrayed in channels in the axis flange 7 of the inductor 4. With their ampere-turns in the axis flanges 3 and 7 of the thermal roller 1 and the inductor 4, the phase currents flowing in the power connection lines 17, 18 cause magnetic fluxes that can be used to heat the axis flanges or will otherwise have to be suppressed.

Figure 8:
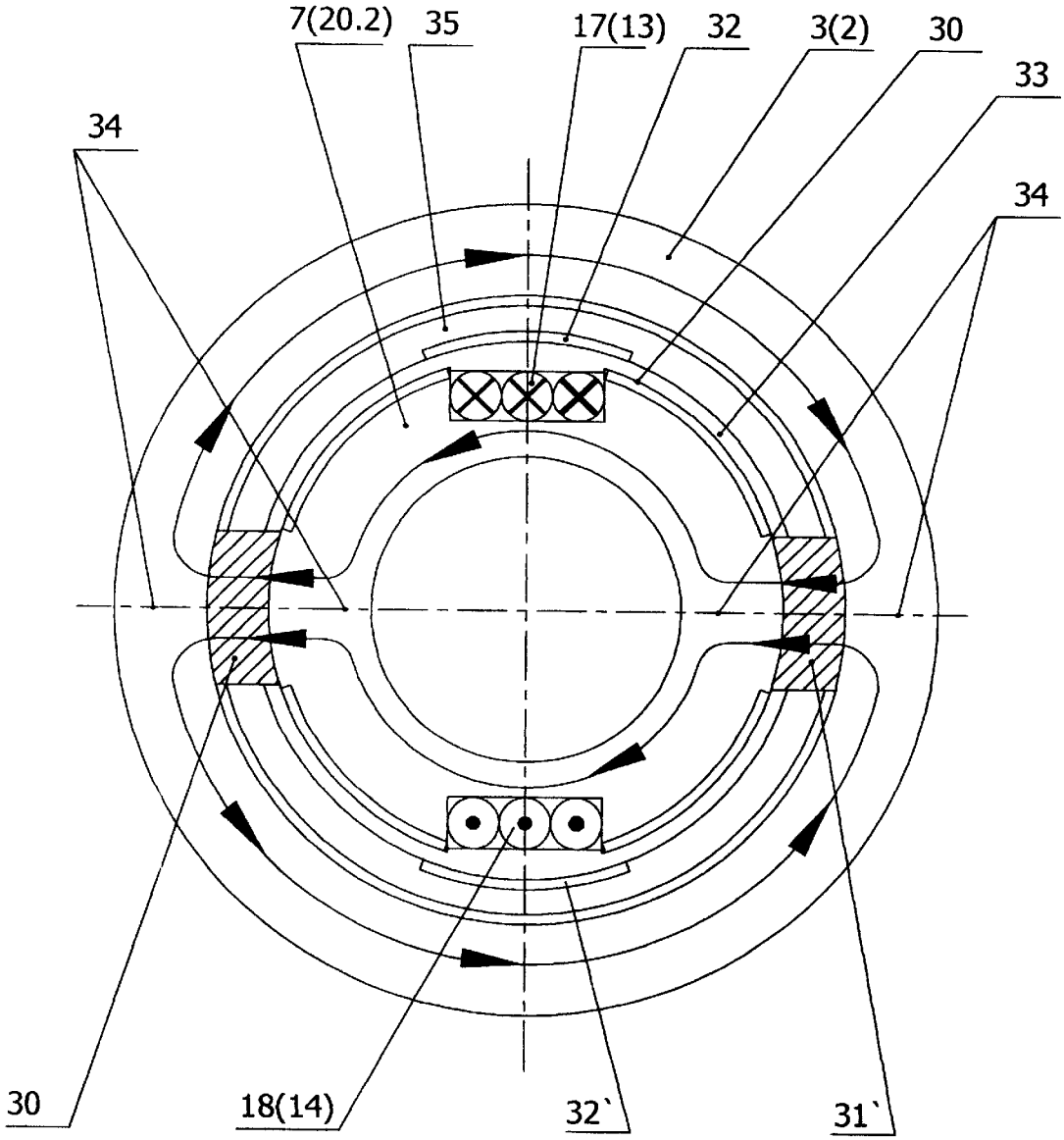
FIG. 8 a cross-section through the axis flange of the thermal roller with the inductor in a two-phase embodiment with the pole bridges in the couple position FIG. 9 a cross-section through FIG. 8 with the pole bridge array in the screening position.
Figure 9:
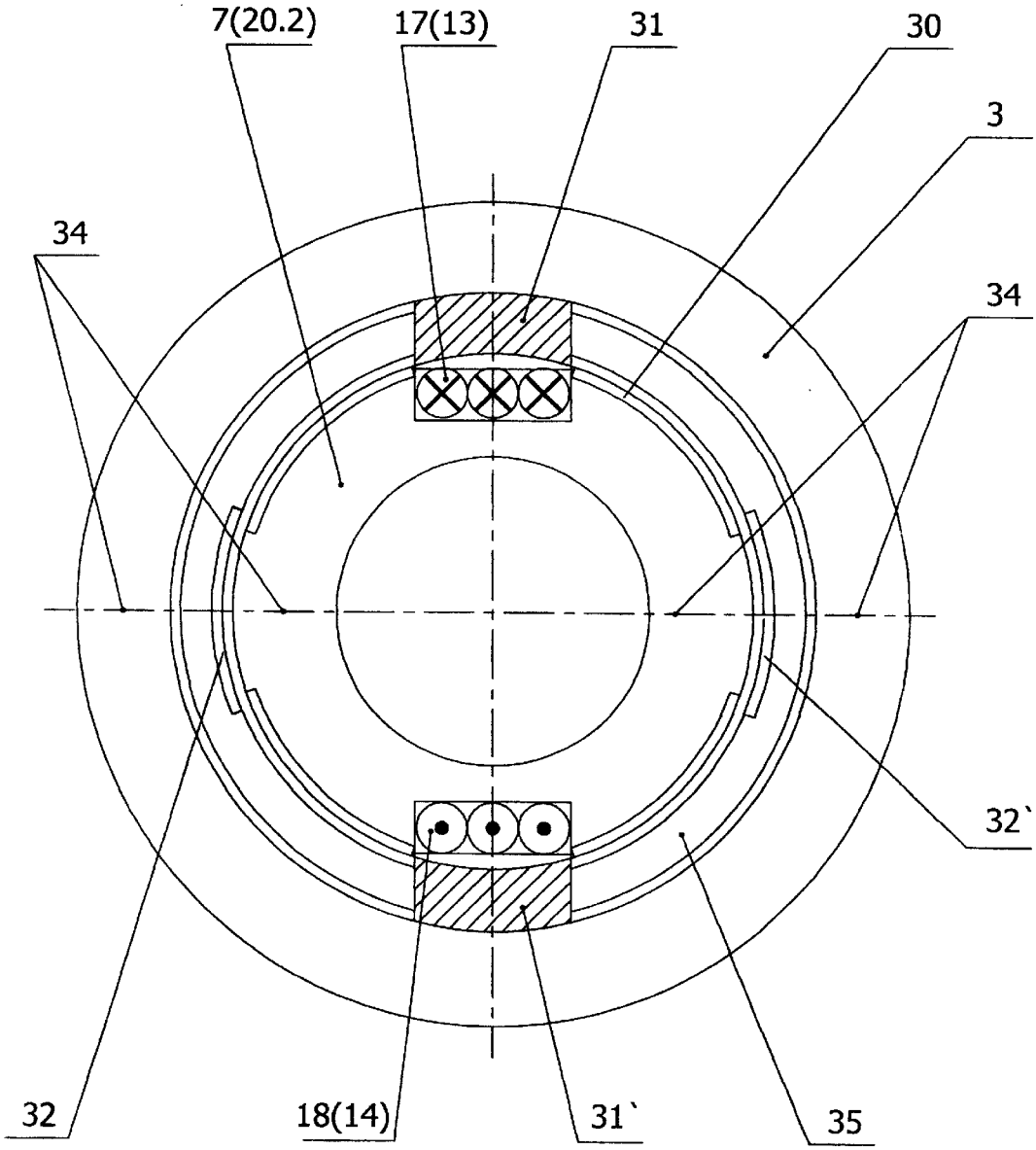

FIG. 8 and 9 illustrate an embodiment that offers this possibility by means of adjusting various different magnetic circuit constellations. FIG. 8 illustrates the embodiment in the position in which the magnetic flux is used for heating, while FIG. 9 illustrates the magnetic circuit in the position in which the magnetic flux is effectively suppressed.

The two-phase magnetic circuit arrangement consists of the axis flange 3 of the thermal roller 1, the axis flange 7 of the inductor 4 with the electromagnetic screen cap 30 and the adjustment ring 35 with the pole bridges 31 and the electromagnetic pole screen cap 32.

In FIG. 8, the pole bridges 31 consisting of ferromagnetic material bridge the air gap 33 in the area of the circumference between each pair of screen caps 30 and thus form in each case a magnetic circuit for each of the two power supply lines 17 and 18 with a magnetic resistance of equal size.

In these magnetic circuits, the amper-turns are driven by the magnetic fluxes of the phase flows in the power supply lines 17 and 18, as illustrated by means of arrows in FIG. 8. This induces eddy currents in the axis flanges 3 and 7, which generate a heating effect there.

Should this heating effect be undesirable, the pole bridges 31 are positioned radially over the power connection lines 17 and 18 and the electromagnetic pole screen caps 32 are positioned over the pole 34 of the magnetic circuit by turning the adjustment ring 33 through 90°. In this way, the axis flange 3 of the thermal roller 1 is completely electromagnetically screened from the axis flange 7 of the inductor 4. The magnetic circuits of the power supply lines 17 and 18 are practically uninterrupted by this, so that the magnetic flux is effectively suppressed.

Between the positions of complete closure and complete aperture of the magnetic circuit or the complete formation and the complete suppression of the magnetic flux, as illustrated in FIG. 8 and FIG. 9, intermediate positions can also be chosen by suitably turning the adjustment ring 35.

The magnetic circuit arrangement illustrated in FIG. 8 and FIG. 9 can also obviously be used to heat the roller jacket. In this case, Pos. 3 indicates the roller jacket 2, Pos. 7 the transverse yoke 20.2 and Pos. 17 and Pos. 18 the current conductors 13', 14' of the two phases of the inductor 4. The transverse yoke 20.2 can thus be the crosshead of a deflection compensation roller, over which a coiled cylinder of thin, insulated sheet is arrayed concentrically as a magnetic conductor.

The pole bridges are then appropriately executed or integrated into these as hydraulic elements.

What is claimed is:

1. An induction heating system for a thermal roller comprising a rotatable hollow roller jacket having flanges at opposite ends thereof, the flanges concentrically surrounding the axis of the roller jacket and the roller jacket defining an enclosed space, and an inductor arranged within the enclosed space and inductively coupled with the roller jacket, the inductor consisting of an inductor spool through which a current flows and a magnetic core formed by the roller jacket, the inductor spool comprising a plurality of elongated outer current conductors peripherally arrayed close to an inner surface of the roller jacket and extending parallel to the axis at least across the greatest surface width of the roller jacket, the inductive coupling with the roller jacket being adjustable in zones, and flanges concentrically surrounding the axis, the roller jacket flanges forming bearings for the inductor spool flanges.

2. The induction heating system of claim 1, wherein the current is a single-phase current.

3. The induction heating system of claim 1, wherein the current is a poly-phase current.

4. The induction heating system of claim 1, wherein the current conductors are rod-shaped.

5. The induction heating system of claim 1, wherein the current conductors are shell-shaped.

6. The induction heating system of claim 1, wherein the inductor spool flanges are fixedly mounted in the roller jacket flanges.

7. The induction heating system of claim 1, wherein the inductor spool flanges are rotatably mounted in the roller jacket flanges.

8. The induction heating system of claim 1, wherein the outer current conductors are electrically connected with at least one contact path extending parallel to the axis along an inner surface of the inductor spool the inductor spool further comprises an inner current conductor arranged close to the axis, inner slide contacts carried by slide contact carriers being guided along the inner current conductor and outer slide contacts being guided along the contact path, the current flowing through the outer current conductors only in the zones to be coupled inductively to the roller jacket, the inner current conductor is divided at the axial center into two parts electrically insulated from each other and passes through the roller jacket flanges at the opposite ends, an alternating current source is connected to the inner current conductor, the slide contact carriers are arranged symmetrically with respect to the axial center and are secured to spindle nuts, each of which has an opposing pitch of equal height to a spindle nut at the opposite roller side, and a magnetic screen at least partially screening the inner current conductor.

9. The induction heating system of claim 8, wherein the outer current conductors are electrically connected over the entire length thereof.

10. The induction heating system of claim 8, wherein the outer current conductors are electrically connected over partial sections thereof.

11. The induction heating system of claim 8, wherein the magnetic screen screens the entire inner current conductor.

12. The induction heating system of claim 8, wherein the magnetic screen is comprised of a ferromagnetic jacket defining an axially extending air gap.

13. The induction heating system of claim 12, wherein the magnetic screen carries a circumferentially extending layer of an electrically well conducting material acting as an electromagnetic screen.

14. The induction heating system of claim 12, wherein the ferromagnetic jacket is comprised of two half-shells extending to the periphery of the roller jacket, the half-shells being rotatable with respect to each other at least at the periphery.

15. The induction heating system of claim 12, wherein the ferromagnetic jacket is comprised of two half-shells extending to the roller jacket flanges, the half-shells being rotatable with respect to each other at least at the flanges.

16. The induction heating system of claim 1, wherein the outer current conductors are connected to a poly-phase alternating current at both ends and form two phase groups electrically insulated from each other, the phase groups being interconnected at one end, a yoke is arranged rotatably in the enclosed space and extending over the greatest surface width, the yoke extending in its initial position between the peripheral phase limits and being divided into axial sections of ferromagnetic material, the axial sections being rotatable with respect to each other and having pole shoes at the ends thereof, the yoke and the roller jacket defining a peripherally variable air gap therebetween, and each axial section having its own rotary axle.

17. The induction heating system of claim 16, wherein the rotary axles pass through one of the roller jacket flanges for actuation outside the thermal roller.

18. The induction heating system of claim 16, wherein the phase groups extend over differently dimensioned areas of the roller circumference, and the yoke is a circular disc segment rotatable about the axis.

19. The induction heating system of claim 16, wherein the yoke is in slidable contact with the inner surfaces of the outer current conductors, the yoke and the outer current conductors being electrically insulated from each other.

20. The induction heating system of claim 19, wherein the outer current conductors have a thin electrically insulating coating.

21. The induction heating system of claim 19, wherein the ends of the yoke carry electrically insulating caps.

22. The induction heating system of claim 16, wherein the current conductors of the phase groups extend over differently dimensioned areas of the inner circumference of the roller jackets.

23. The induction heating system of claim 16, wherein the outer current conductors are connected to current supply lines passing through a flange of the roller jacket, and pole bridges covering the supply lines and electromagnetic pole screen caps are coaxially arranged for rotation in phase between the supply lines and the roller jacket flange to serve as sliding bearing means between the roller jacket and induction spool flanges, selective rotation producing either a magnetically conductive connection or magnetic screening between the roller jacket flanges and the inductor spool flanges.

24. The induction heating system of claim 16, further comprising pole bridges covering the outer current conductors and electromagnetic pole screening caps are arranged between the roller jacket and the outer current conductors for rotation in phase, selective rotation producing either a magnetically conductive connection or an interruption between the roller jacket and the yoke, the yoke being comprised of a hollow cylinder which is coaxial with the inductor spool.

25. The induction heating system of claim 1, wherein the induction spool is stationary, and the outer current conductors are spaced from the roller jacket by a distance at least equal to a maximum flexing of the thermal roller during operation.

26. The induction heating system of claim 1, wherein the inductor spool is fixedly connected to the roller jacket, and the outer current conductors are guided on a collector for producing an ampere-windings axis, the collector providing an electrical connection to a source of current.

27. The induction heating system of claim 1, wherein at least some of the outer current conductors are comprised of a plurality of partial conductors electrically insulation from each other and connected in series to form axial windings.

28. The induction heating system of claim 1, wherein the current is comprised of a direct current superimposed upon an alternating current.

29. The induction heating system of claim 1, wherein a layer of a material having a substantially lower specific electrical resistance than that of the roller jacket is arranged immediately adjacent an inner surface of the roller jacket, the layer having a thickness corresponding to the depth of penetration of the electrical field.

* * * * *